US006578978B1

(12) United States Patent
Upton et al.

(10) Patent No.: US 6,578,978 B1
(45) Date of Patent: Jun. 17, 2003

(54) DISPLAY CASE HAVING A MULLION WITH RECESSED LIGHT FIXTURES

(75) Inventors: Ronald D. Upton, Spartanburg, SC (US); Harry A. Brancheau, Inman, SC (US)

(73) Assignee: Specialty Equipment Companies, Inc., Aurora, IL (US)

( * ) Notice: Subject to any disclaimer, the term of this patent is extended or adjusted under 35 U.S.C. 154(b) by 14 days.

(21) Appl. No.: 09/744,261

(22) PCT Filed: Jun. 7, 2000

(86) PCT No.: PCT/US00/40142

§ 371 (c)(1),
(2), (4) Date: Jan. 22, 2001

(87) PCT Pub. No.: WO00/75561

PCT Pub. Date: Dec. 14, 2000

Related U.S. Application Data

(60) Provisional application No. 60/137,989, filed on Jun. 7, 1999.

(51) Int. Cl.[7] ..... F25D 27/00

(52) U.S. Cl. ..... 362/92; 362/125; 362/133; 362/278; 62/264

(58) Field of Search ..... 362/92, 125, 127, 362/225, 133, 223, 260, 278; 312/223.4; 62/264

(56) References Cited

U.S. PATENT DOCUMENTS

| | | | | |
|---|---|---|---|---|
| 3,211,904 A | | 10/1965 | Schwenkler | |
| 3,612,848 A | * | 10/1971 | Koch et al. | 312/223.5 |
| 5,301,092 A | * | 4/1994 | Santosuosso et al. | 312/223.5 |
| 5,471,372 A | | 11/1995 | Mamelson et al. | |
| 5,645,330 A | | 7/1997 | Artwohl et al. | |
| 5,879,070 A | | 3/1999 | Severloh | |

* cited by examiner

*Primary Examiner*—Sandra O'Shea
*Assistant Examiner*—Ali Alavi

(57) ABSTRACT

A refrigerated display case and process of illuminating the case is provided. The display case has a support mullion (22) positioned in proximity to a glass door. A fluorescent lamp (34) is located within a lateral opening along either side of the support mullion (22). A diffusing lens (32) is positioned within the lateral opening, opposite the lamps, scattering the light as it passes through from the side of the mullion and through the diffusing lens (32). The glass door provides a reflective surface which reflects a substantial portion of the scattered light towards the interior space of the display case.

22 Claims, 6 Drawing Sheets

DISPLAY CASE HAVING A MULLION WITH RECESSED LIGHT FIXTURES

RELATED APPLICATIONS

This application claims the benefit of U.S. Provisional Application Serial No. 60/137,989 filed on Jun. 7, 1999 and which is incorporated herein by reference.

FIELD OF THE INVENTION

The present invention is generally directed towards a display cabinet and particularly a commercial display cabinet having an internal lighting system and assembly.

BACKGROUND OF THE INVENTION

A wide variety of commercial display cabinets exists. One common type of a refrigerated display cabinet includes a cabinet frame which extends generally about the periphery of the front of the display cabinet. The frame includes an upper frame member, a lower frame member, two laterally spaced side frame members extending vertically between the upper and the lower frame members, and a center mullion which extends vertically between the upper frame member and the lower frame member and connected thereto. The mullion provides support for the cabinet frame, associated doors, and also provides a sealing surface against which portions of the door assemblies engage and seal for effective sealing of the refrigerated cabinet. Typically, mullions are also equipped with electrical conduits for delivering electrical power to anti-condensation devices for the door assemblies and for a fluorescent lighting fixture associated with the mullion.

One popular design for a refrigerator or freezer cabinet frame assembly provides for one central mullion, a door stop for a pair of doors, each door pair member being mounted to a respective front edge of the display cabinet. Thus, the doors open from the front center of the cabinet with the left opening door pair member having hinge pins on the left side of the door and the right opening door pair member having hinge pins on the right side of the door. The central mullion provides a gasket covered surface and support for engaging and securing the doors in a closed position.

A fluorescent light is typically mounted on the rear surface of the center mullion so as to illuminate the interior of the display cabinet. Proper illumination of the merchandise present within the display cabinet is important so as to maintain an attractive product appearance and to allow a customer to visually locate merchandise within the cabinets prior to opening the cabinet door. Various louvered reflectors have been disposed inside the cabinet to redirect the light within the cabinet. As such, it is desirable to provide a refrigerated display cabinet having a lighting assembly which improves the illumination of the cabinet merchandise.

The construction and components used in an illuminated refrigeration or freezer display cabinet are well known in the art. For instance, U.S. Pat. Nos. 5,471,372 to Mamelson et al. and 5,879,070 to Severloh, are directed to the construction of lighted refrigerated display cases, these references being incorporated herein by this reference.

SUMMARY OF THE INVENTION

In accordance with the present invention, an improved refrigerated display case having a central vertical mullion spaced opposite the handle portion of adjacent side pivoted doors is provided. The central mullion is secured at its top and its bottom to the cabinet frame, and a pair of rectangular doors are mounted to opposite sides of the frame on vertical hinge axes for swinging movement between open positions and closed positions. In the closed position, the central mullion defines a front surface adapted to seal with the rectangular door inner surface. The central mullion is generally rectangular and hollow and has a front surface facing outwardly of the cabinet assembly, a back surface facing inwardly of the cabinet assembly, the two sides of the mullion being open and adapted for receiving a fluorescent lighting assembly. The lighting assembly positions a fluorescent bulb within each side of the center mullion whereby the bulb may be easily accessed and replaced. This placement also allows a significant portion of the bulbs' illumination to be directed towards and reflect from the interior glass door surface and thereby increase the effective illumination within the cabinet's interior. An outer protective lens is removable to access the light assembly components. In one embodiment of the invention, the leading edge of each door is canted outwardly forming an approximate 77.5 degree angle relative to an axis perpendicular to a plane defined by a rear cabinet wall.

DETAILED DESCRIPTION OF THE INVENTION

It is to be understood by one of ordinary skill in the art that the present discussion is a description of exemplary embodiments only, and is not intended as limiting the broader aspects of the present invention, which broader aspects are embodied in the existing construction.

In describing the various figures herein, the same reference numbers are used throughout to describe the same apparatus. To avoid redundancy, detailed descriptions of much of the apparatus once described in relation to a figure is not repeated in the descriptions of subsequent figures, although such apparatus is labeled with the same reference numbers.

Figure 1:
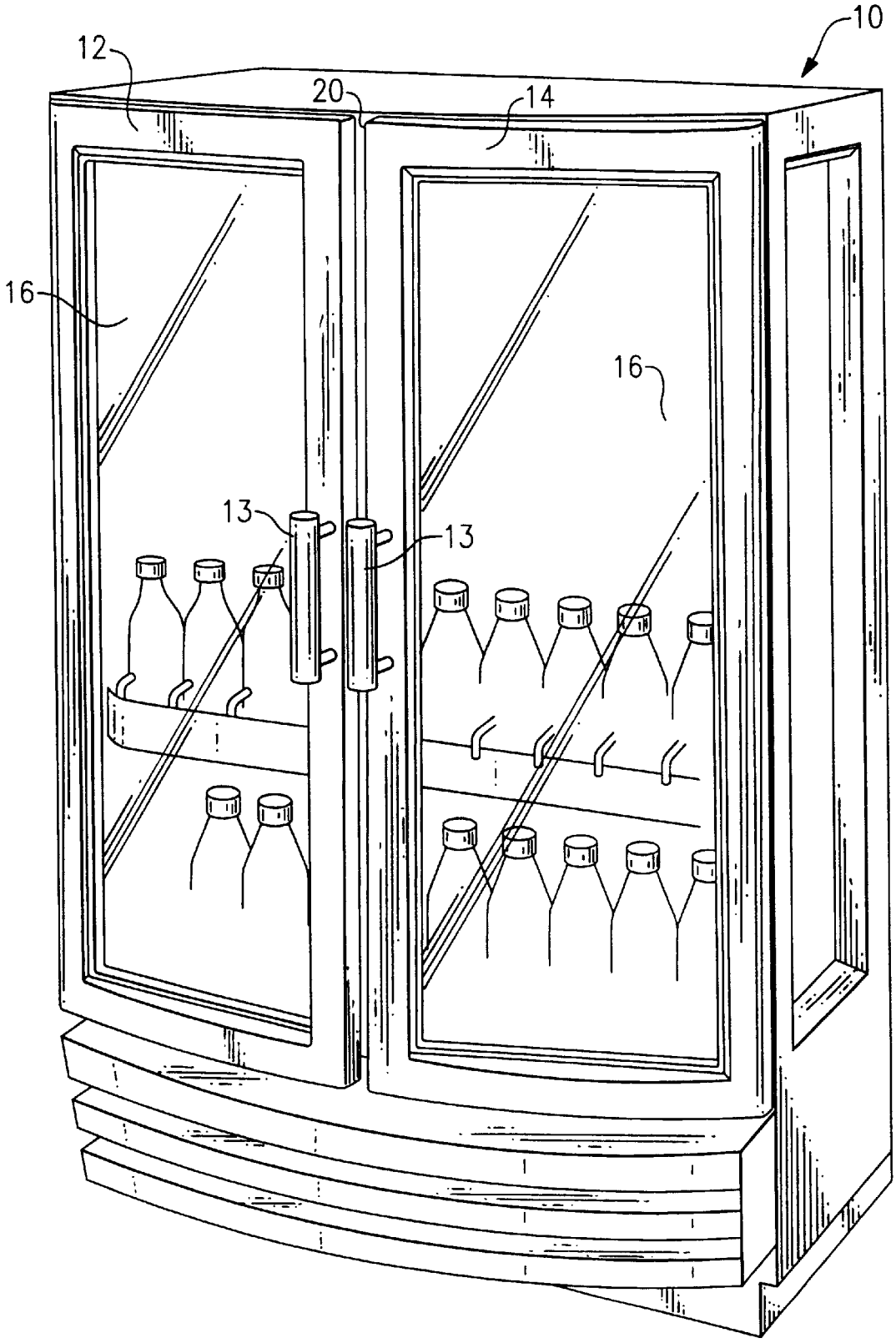
FIG. 1 is a front perspective view of a display case in accordance with the present invention.

In reference to FIG. 1, a refrigerated display case 10 is provided having a cabinet which defines an enclosure having an interior space accessible via a front opening. A pair of doors 12 and 14 is supported by the cabinet and may be selectively positioned to close the cabinet's front opening or allow access to the interior space of the cabinet's enclosure via the front opening. Each door 12, 14, includes a panel 16 that is transparent or translucent to permit viewing of the product within the enclosure and is movable to provide access to the product. As illustrated in the figures, doors 12 and 14 are mounted to opposite sides of case 10 in a conventional manner for swinging movement between an open position and a closed position. However, the hinge portions of the doors could be installed along the center mullion so that the doors open from opposite ends of the display case. Handles 13 are used to engage and pivot the doors 12 and 14. If desired, the movable doors could be provided by one or more sliding glass doors.

An inner perimeter of each door defines a conventional seal and gasket arrangement to provide a substantially air tight thermal barrier for case 10 when the respective doors are closed. As seen in reference to FIG. 3, a portion of door gasket 40 carries a magnet 42 which helps maintain the pivoting doors 12 and 14 in a closed position.

Figure 2:
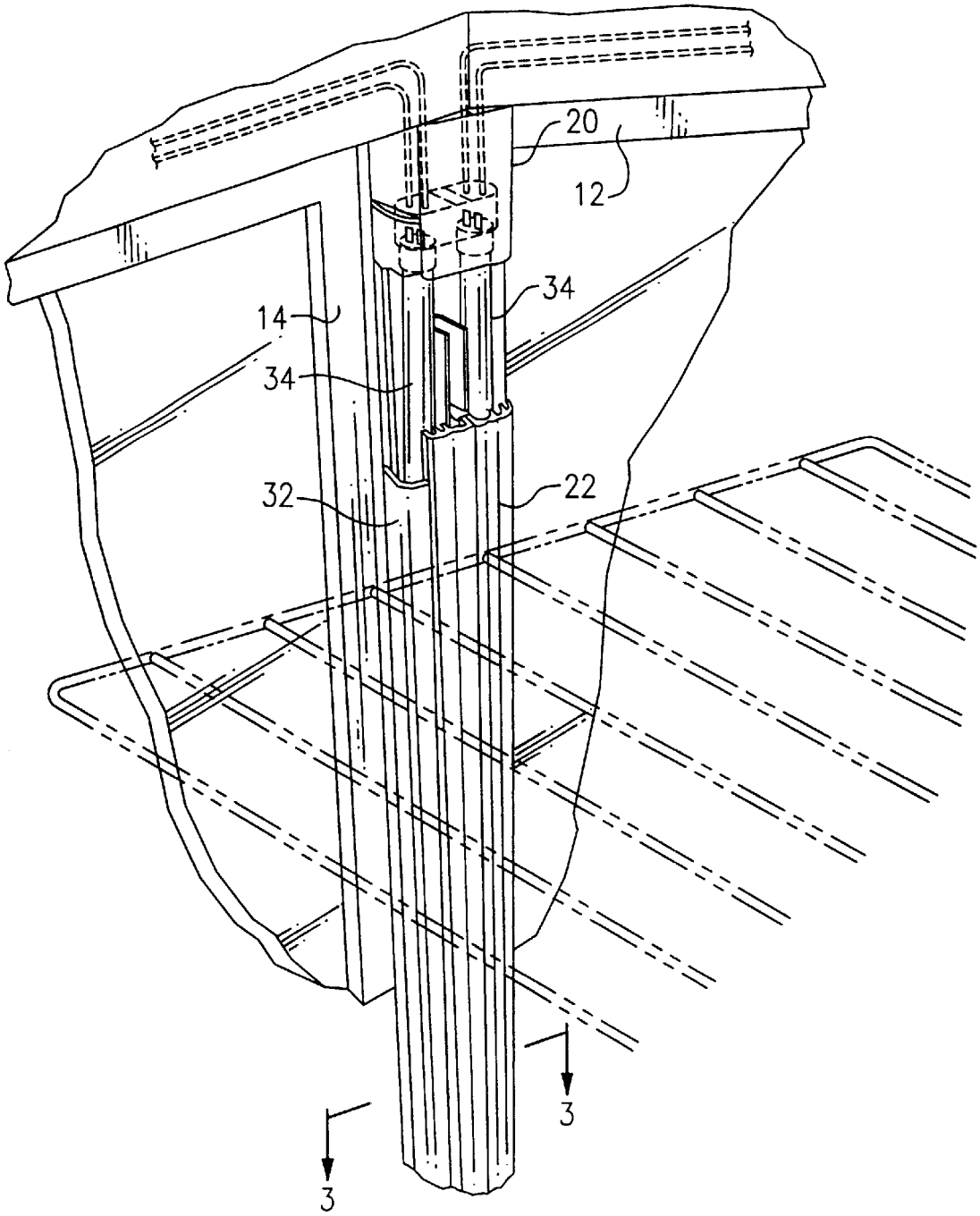
FIG. 2 is a perspective view in partial section of a central support mullion and associated doors as seen from an interior of the case.

As seen in reference to FIG. 2, a central mullion is designated generally by the numeral 20 and extends the height of the enclosure and is positioned opposite a leading edge of door 12 and door 14 when oriented to close the front opening of the cabinet. The mullion 20 extends the height of the enclosure and is positioned opposite a leading edge of each of the individual doors 12 and 14. The mullion has a front surface 24, a back surface 28 opposite the front, and a pair of opposed sides extending between the front and the back, each side defining a lateral opening 26.

Figure 4:
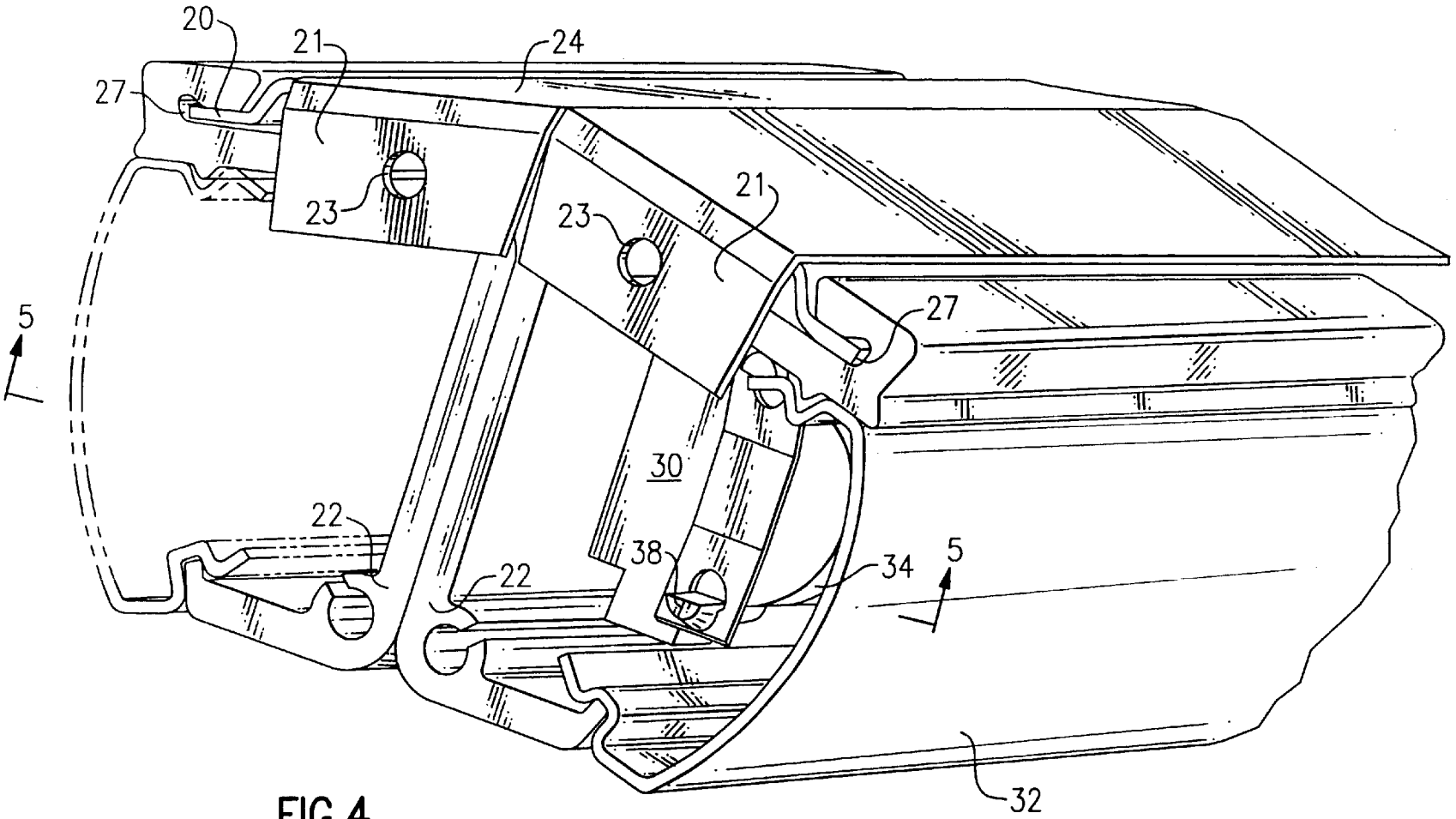
FIG. 4 is a perspective view of an embodiment of a central mullion with details of the light assembly components.
Figure 5:
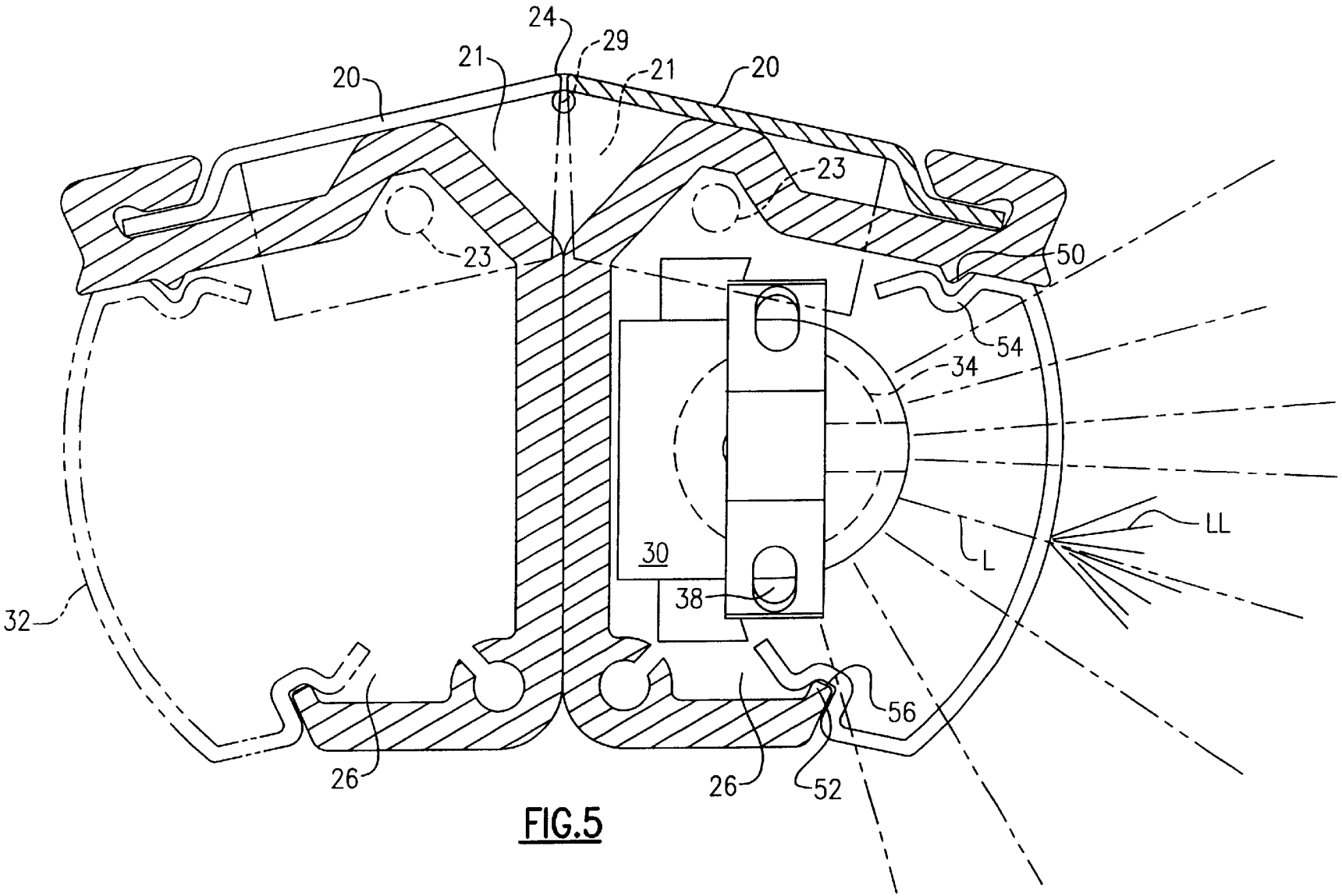
FIG. 5 is a sectional view taken along line 5—5 of FIG. 4.

As explained more fully below and shown in FIG. 5 for example, mullion 20 defines a front face 24 which is formed of a magnetic material that will attract the magnet 42 of the door gaskets. As shown in FIGS. 4 and 5 (chain-dashed line), mullion 20 further defines a pair of integral upper flanges 21 which are used to secure the mullion to the cabinet front, each flange 21 defining an aperture 23 for attaching the mullion to the cabinet. Each side edge 27 of front face 24 engages a respective support member 22, which is desirably fabricated as a plastic extrusion. Support member 22 defines a front surface 25 and a rear surface which defines mullion back surface 28. A resistive wire 29 provides a heating element disposed against the inner surface of the mullion face to reduce condensation on the portion of the mullion's face 24, which is exposed to the external environment when the doors are opened. Alternatively, insulation (not illustrated) may be installed for this same purpose as is conventional within the art.

Figure 3:
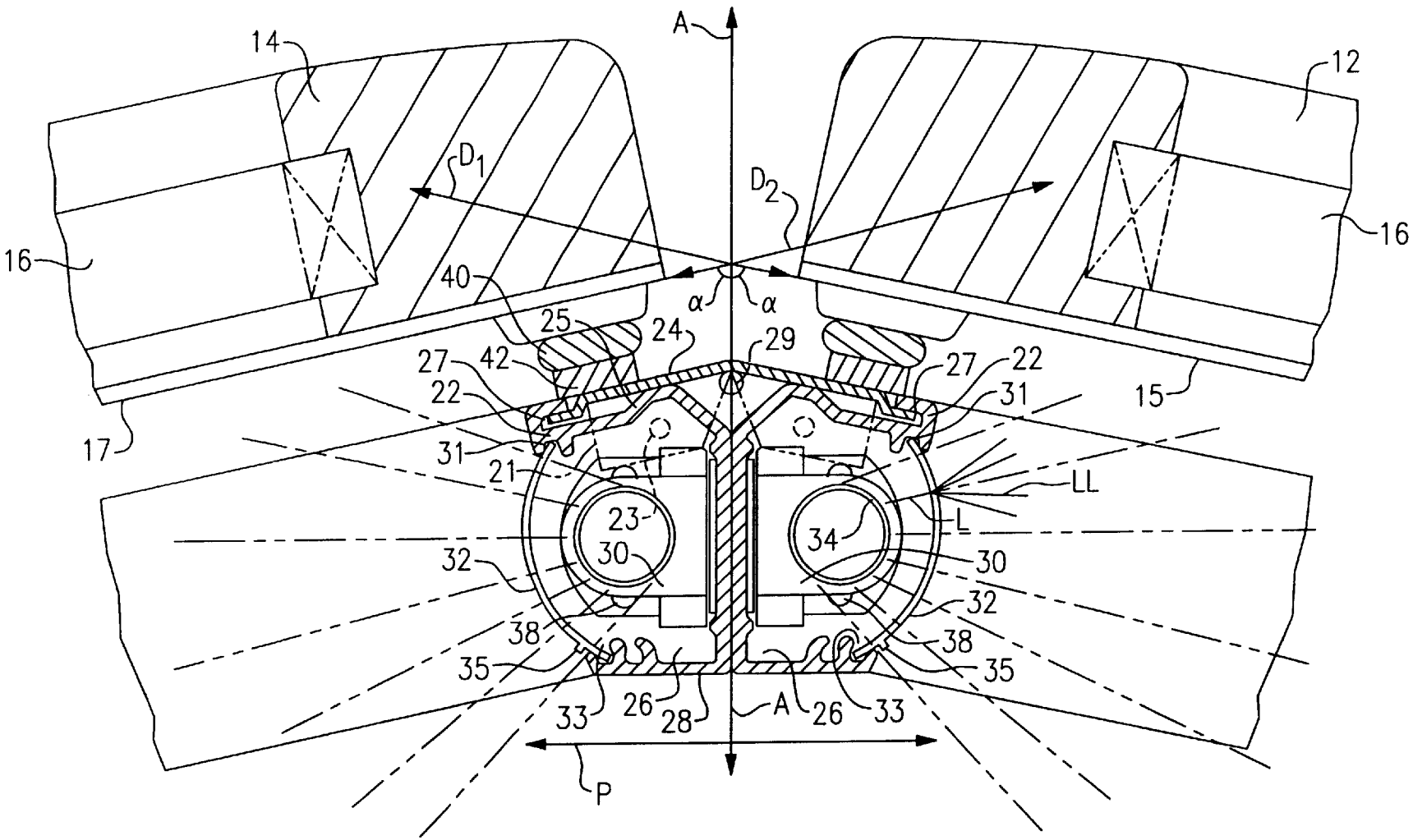
FIG. 3 is a sectional view taken along line 3—3 of FIG. 2.

As best seen in reference to FIGS. 3 and 4, a light fixture 30 is supported within each lateral opening 26 defined by support member 22 along either side of the mullion. Each light fixture 30 is configured and disposed for receiving and supporting an illumination source such as a fluorescent bulb 34. As shown in FIG. 3, a mounting clip 37 receives the electrical end prongs 38 of each bulb 34. A light diffuser such as a diffusing lens 32 is positioned within the lateral openings 26 and opposite the light fixture 30 and bulb 34 so as to diffuse the direction and intensity of light emanating from the illumination source. Lens 32 covers the lateral openings 26.

As seen in reference to FIG. 4, the front face 24 of center mullion 20 engages the support member 22 along either edge 27 of front face 24. A pair of mounting flanges 21 extend normally with respect to the main body of front face 24 and over a portion of the mullion's interior and define a hole 23 for attaching the mullion to the display case's cabinet. Each extruded support member 22 provides a U-shaped housing, the interior of which is adapted for receiving the light fixture 30. In reference to the orientation seen in FIGS. 3 and 5, the lateral opening 26 along each side of the mullion 20, is defined by support member 22 is configured to and allow each bulb 34 to emit light through the respective lateral opening 26, passing through diffusion lens 32. As seen in FIGS. 3 and 5, the diffusing effect of lens 32 is indicated schematically as a single directional ray of light, designated as "L", which is diverged into multiple rays ("LL") upon passing through the lens 32. For clarity of illustration, only a single ray "L" is shown diverging into multiple rays "LL".

Lens 32 may be provided by a flexible curved piece of translucent plastic which is removably held in a tensioned fashion by support member 22. As best seen in reference to FIG. 5, it has been found useful to provide a first ridge 50 and a second ridge 52 as part of support member 22. Ridges 50, 52 generally define therebetween lateral opening 26. Ridges 50 and 52 are used to engage respective correspondingly shaped first notch 54 and second notch 56 formed near opposite edges of the embodiment of lens 32 shown in FIG. 5. Preferably, lens 32 has sufficient flexibility that a simple lens 32 may be easily inserted and removed by providing a slight compressive action to the terminal ends of the lens 32.

In an alternative configuration of lens 32 and support member 22 shown in FIG. 3 for example, recessions 31 and 33 are formed in the opposite side edges of support member 22 and configured to receive the respective side edges of lens 32. A boss 35 is provided along the exterior surface of lens 32 to provide a means of gripping lens 32 to pry it from engagement with support member 22.

Figure 6:
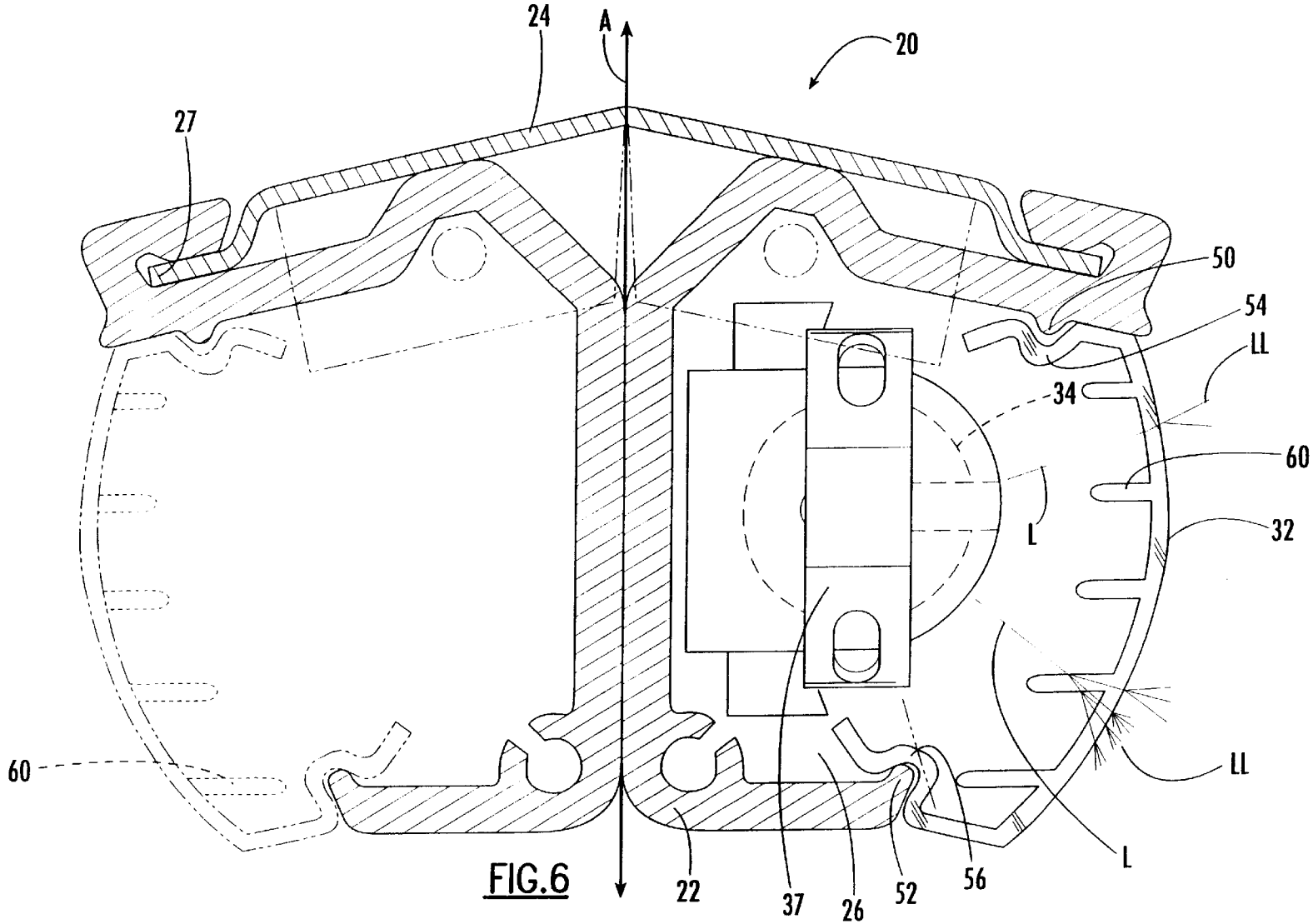
FIG. 6 is a sectional view similar to FIG. 5 showing an alternative embodiment of a lens construction.

Yet another alternative configuration of lens 32 is shown in FIG. 6. An inner surface of lens 32 defines a plurality of inwardly directed projections 60. Each projection 60 extends along the length of the lens 32 and may be integrally formed with lens 32. Collectively, projections 60 define a baffle or series of blind-like slats which alter the direction and intensity of emitted light in comparison to a lens 32 without the projections.

As seen in FIG. 6, projections may be substantially perpendicular to reference line A so as to achieve a substantially uniform distribution of light horizontally across the front edges of the display shelves. However, depending upon the desired illumination effect, the spacing between the projections, the number of projections, the relative angles of one or more of the projections, the size, thickness, and length of the projections may be modified. As further seen in reference to FIG. 6, the projections 60 may extend inwardly different lengths, depending upon location, so as to affect the amount and direction of transmitted light.

The projections 60 do not alter the pathway of light rays (L) which pass between the opposite projections. However, rays (L) which strike a single projection 60 will partially block and alter the resulting scatter light "LL". As a consequence, projections 60 serve to soften and lower the intensity of emitted light rays which pass through or impact an internal projection 60. Further, there is a corresponding increase in the relative amount and intensity of the light fractions which are transmitted between the projections. The improved gradient of transmitted light prevents over-illumination of product immediately adjacent the light source and improves the illumination quality of product which is more distant from the light source.

In accordance with this invention, it has been found that the glass door will reflect a significant portion of the light emitted from a lateral opening 26, redirecting the reflected light towards the interior of the cabinet. The reflected light from the door's interior surface provides an even, front illumination source of reflective light for merchandise displayed within the cabinet. Additional lighting is provided directly from light passing through the diffuser lens. This combination of lighting provides for an even product illumination.

If desired, support member 22 can be provided from a transparent or translucent material such as polycarbonate or other clear or translucent plastic. The light transmitting support member will allow a broader distribution pattern of light from the mullion, the distribution pattern not being limited to the physical dimensions of the lateral opening. Alternatively, support member 22 may be coated with a reflective or non-absorbing paint so as to increase the efficiency of the light source.

In the illustrated embodiment shown in FIG. 3 for example, a reference line "A" is defined to extend perpendicular to a rear plane defined by the rear wall (not shown) of the cabinet. Line "P" is used as a reference point, reference line "P" being parallel to the rear wall plane. Reference line "A" bisects the front cabinet face along a midpoint of a mullion. In the illustrated embodiment, this midpoint of the mullion also defines a point along the front edge of the cabinet mullion which extends outwardly and forwardly the greatest distance from the interior of the cabinet.

As seen in reference to FIG. 3, an angle $\alpha$ is formed between the intersection of reference line "A" and planes "$D_1$" and "$D_2$" defined respectively by the interior perimeter surfaces 15 and 17 of doors 12 and 14. Angle $\alpha$ is desirably between about 75 degrees to about 90 degrees, preferably between about 75 to 85 degrees, still more preferably between 76 to 79 degrees and still more preferably between 77 to 78 degrees. In the illustrated embodiment, angle $\alpha$ is about 77.5 degrees. When angle $\alpha$ is 90 degrees, surfaces 15 and 17 are parallel to plane P.

For the purposes of this invention, when angle $\alpha$ is about 90 degrees, a parallel arrangement exists between the plane of the inner door frame and the plane P defined by the rear wall of the cabinet. In other words, in this parallel arrangement, bulb(s) 34 provide(s) a substantial amount of illumination that is desirably reflected from the interior door surface 15 and/or 17 towards the display area of the shelves inside the case 10. The diffusing lens 32 directs a portion of the light from the side of the mullion to the door surface at a sufficient angle to create a reflected light component which is directed towards the interior of the cabinet. However, by reducing the value of angle $\alpha$, it has been further found that a greater proportion of the illumination striking the interior door surface may be reflected towards the cabinet display area.

It is also envisioned that the interior door surface may be provided by a piece of angled or curved glass or other transparent or translucent material. For instance, as viewed from the interior of the cabinet, a slight, generally concave curvature may be provided to the reflecting portion of the door. Such a curvature may provide a more efficient reflective surface in the sense that it increases the amount of light reflected to the interior of the display case. Further, the curved door surface could be used to favorably direct or concentrate the reflected light to a desired region of the cabinet. A similar effect may be achieved by having one or more angled facets defined by the interior reflective face of the door.

The present invention provides a useful process for improving the illumination of a cabinet. By directing discharged light toward the interior surface of the door, the door may provide a reflective surface which redirects the light towards the interior space of the cabinet. The position of the reflective door surface, relative to the illumination source, may be varied to increase the amount of light which is reflected.

The interior door surface may further define a curved or multifaceted reflective surface to increase the amount of reflected light and/or the direction of the reflected light. Further, a coating layer may also be applied to the interior door surface to increase the surface's reflective properties. Such coatings, as known in the art, still allow the interior of the display case to be viewed through the transparent door.

Prior art lighting systems for similar cabinets, make use of a single light fixture positioned upon the rear mullion surface that faces the interior of the cabinet. The resulting lighting is uneven and has prompted the use of various louvers and reflectors as mentioned in the background section above.

The present invention, using a standard size mullion, provides for a dual bulb lighting, effectively doubling the amount of available light. Further, by directing the light through a diffuser, harsh illumination is avoided. The lighting is enhanced further by positioning a reflective surface of the door relative to the light fixture to reflect additional light towards the display areas of the cabinet. Projections defined along the interior surface of the diffuser provide yet an additional light distributing mechanism to increase illumination along the entire front display region while minimizing harsh glare or uneven illumination patterns. The resulting light provides a balance to the illumination, minimizing shadows and harshness associated with unidirectional lighting systems.

While the illustrated embodiments discussed above are in reference to a single center mullion cabinet construction, the advantages of the improved lighting of the present invention may be used with different styles of cabinets. For instance, wide refrigeration or freezer units may have multiple mullions, each mullion simultaneously engaging the support hinge of one door along one side of the mullion while the opposite mullion side engages the handled door edge of an adjacent door. The multiple mullions can provide the side emitting light features and construction as described above to enhance the illumination and light qualities of the display cases.

Additionally, the display case need not be refrigerated to take advantage of the center mullion side lighting assembly of the present invention. Although desired embodiments of the invention have been described using specific terms, materials, and methods, such description is for illustrative purposes only. The words used are words of description rather than of limitation. It is to be understood that changes and variations may be made by those of ordinary skill in the art without departing from the spirit and scope of the present invention which is set forth in the following claims. In addition, it should be understood that aspects of the various embodiments may be interchanged, both in whole or in part.

What is claimed is:

1. A display case comprising:

a cabinet defining an enclosure with height, width, a rear plane and an interior space;

a door supported by the cabinet for permitting viewing of product within the interior space of the enclosure and movable to permit access to the interior space of the enclosure, said door having an interior perimeter frame supporting a panel defining an interior surface of the cabinet, the interior perimeter frame of said door defining a plane forming an interior angle of between about 75 to about 90 degrees relative to a cabinet axis perpendicular to the rear plane of the cabinet;

a mullion extending the height of the enclosure and positioned opposite a leading edge of the door, said mullion defining at least one lateral opening;

a light fixture supported within the at least one lateral opening defined by the mullion, the light fixture adapted for receiving and supporting an illumination source; and a light diffuser positioned within the lateral opening and opposite the light fixture so as to diffuse the direction and intensity of light from the illumination source whereby a portion of the directed light further reflects off the interior surface of said door into the interior space.

2. A process of lighting an interior of a display case having a door having an interior perimeter frame supporting a panel defining an interior surface of the cabinet and positioned across an opening at the front of the display case comprising:

providing a vertical support member positioned along a front of the display case, the support member having a front surface, a rear surface, and at least one side which defines a lateral opening extending along a length of the support member;

disposing within the at least one lateral opening a light fixture having an illumination source;

directing light discharged from the illumination source to the interior of the display case, a portion of the discharged light being directed to the door's interior surface positioned along a front of the display case at an interior angle of between about 75 to about 90 degrees relative to a cabinet axis perpendicular to a rear plane of the cabinet; and reflecting from the interior surface of the door towards the interior of the display case, a substantial portion of the light that is incident on the interior surface of the door from the illumination source, the reflected light providing illumination for the interior of the display case.

3. A display case comprising:

a cabinet defining an enclosure with height, width, a rear plane and an interior space;

a door supported by the cabinet for permitting viewing of product within the interior space of the enclosure and movable to permit access to the interior space of the enclosure, said door having an interior perimeter frame supporting a panel defining an interior surface of the cabinet, the interior perimeter frame of said door defining a plane forming an interior angle of between about 80 to about 75 degrees relative to a cabinet axis perpendicular to the rear plane of the cabinet;

a mullion extending the height of the enclosure and positioned opposite a leading edge of the door, said mullion defining at least one lateral opening;

a light fixture supported within the at least one lateral opening defined by the mullion, the light fixture adapted for receiving and supporting an illumination source; and a light diffuser positioned within the lateral opening and opposite the light fixture so as to diffuse the direction and intensity of light from the illumination source whereby a portion of the directed light further reflects off the interior surface of said door into the interior space.

4. The display case according to claim 3 wherein the interior angle is between about 79 to about 76 degrees.

5. The display case according to claim 3 wherein the interior angle is between about 78 and 77 degrees.

6. The display case according to claim 3 wherein the interior angle is about 77.5 degrees.

7. The display case according to claim 1 wherein the mullion defines a pair of lateral openings, each opening being configured and disposed for receiving and supporting an illumination source.

8. The display case according to claim 7 wherein the door of the cabinet defines an interior surface, the mullion is configured and disposed so that the illumination source directs light through the lateral opening and through the diffuser in a manner whereby a portion of the directed light further reflects off the interior surface of the door and into the interior space of the enclosure.

9. The process according to claim 2, wherein the step of providing a vertical support member further comprises providing a lateral support member which defines an opening along each side of the support member.

10. The process according to claim 2, wherein the discharged light is directed from a fluorescent bulb.

11. The process according to claim 2 wherein an interior perimeter frame of the door defines a plane which forms an interior angle of between about 80 to 75 degrees relative to a cabinet axis perpendicular to a rear plane of the cabinet.

12. The process according to claim 11 wherein the interior angle is between about 79 to 76 degrees.

13. The process according to claim 11 wherein the interior angle is between about 78 and 77 degrees.

14. The process according to claim 11 wherein the interior angle is about 77.5 degrees.

15. A lighted refrigeration display case comprising:

a cabinet defining an enclosure with a height, a width, and an interior space;

a pair of doors, each individual door supported by the cabinet for permitting viewing of product within the enclosure and movable to permit access to the interior space of the enclosure and further defining an interior door surface;

a mullion extending the height of the enclosure and positioned opposite a leading edge of each of the individual doors, the mullion having a front, a back disposed opposite the front, and a pair of opposed sides extending between the front and the back, each said side defining a lateral opening;

a first light fixture supported within a first lateral opening defined by one of the sides of the mullion, the first light fixture adapted for receiving and supporting a first illumination source;

a second light fixture supported within a second lateral opening defined by the other side of the mullion, the second light fixture adapted for receiving and supporting a second illumination source;

a first light diffusing lens positioned within the first lateral opening and opposite the first light fixture;

a second light diffusing lens positioned within the second lateral opening and opposite the second light fixture; and wherein a substantial portion of the light from the first and second illumination sources which strikes an interior door surface is reflected off the interior door surface to provide a frontal lighting source for the display cabinet.

16. The display case according to claim 15 wherein an interior perimeter frame of one of the doors defines a plane which forms an interior angle of between about 80 to 75 degrees relative to a cabinet axis perpendicular to a rear plane of the cabinet.

17. The display case according to claim 15 wherein the interior angle is between about 79 to 76 degrees.

18. The display case according to claim 15 wherein the interior angle is between about 78 and 77 degrees.

19. The display case according to claim 15 wherein the interior angle is about 77.5 degrees.

20. The display case according to claim 1 wherein the light diffuser further defines a plurality of slat-like projections along an inner surface of the diffuser.

21. The display case according to claim 20 wherein each of the plurality of slat-like projections are substantially parallel with respect to the other slat-like projections.

22. The display case according to claim 1 wherein the diffuser is positioned within the mullion by the engagement of a first notch defined by the diffuser and a second notch defined by the diffuser with a corresponding first ridge and second ridge defined by the mullion.

* * * * *